United States Patent [19]

Salmi

[11] 4,070,949

[45] Jan. 31, 1978

[54] HYDRAULIC STRIKING APPARATUS

[75] Inventor: Pekka M. Salmi, Tampere, Finland

[73] Assignee: Oy Tampella AB, Tampere, Finland

[21] Appl. No.: 734,038

[22] Filed: Oct. 20, 1976

[30] Foreign Application Priority Data

Oct. 20, 1975 Finland ..... 752909/75

[51] Int. Cl.[2] ..... F01L 17/00; F01L 25/04; F01B 7/18

[52] U.S. Cl. ..... 91/276; 91/320; 91/321

[58] Field of Search ..... 91/276, 297, 298, 300, 91/320, 321, 319, 328

[56] References Cited

U.S. PATENT DOCUMENTS 1,593,606 7/1926 Slater ..... 91/276

3,965,799 6/1976 Juvonen et al. ..... 91/321

*Primary Examiner*—Paul E. Maslousky

*Attorney, Agent, or Firm*—Roylance, Abrams, Berdo & Kaul

[57] ABSTRACT

A striking apparatus has a body which carries a tool and which has a cylinder space, a piston structure within the space, and a sleeve-type distributor valve within the cylinder and around the piston. Flow of hydraulic fluid supplied to the body under pressure is controlled by the valve and piston to cause the piston to reciprocate, striking the tool. The sleeve valve has an extension portion which controls flow through a canal in the piston to a valve operating distributor space and limits flow of liquid under pressure to an outlet canal to a relatively short interval in the operating cycle, thereby reducing the amount of liquid wasted.

3 Claims, 2 Drawing Figures

HYDRAULIC STRIKING APPARATUS

Figure 1:
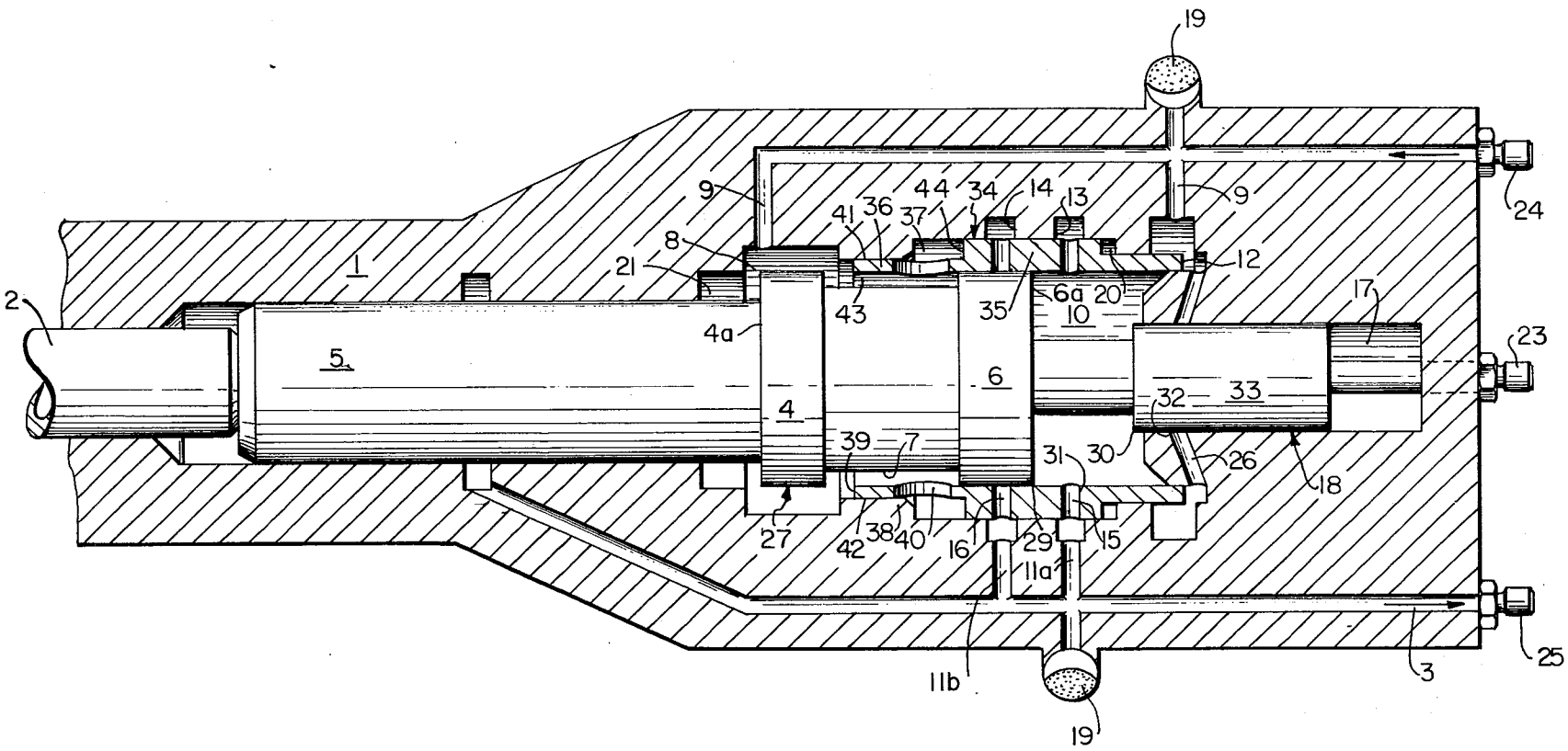

This invention relates to hydraulic striking apparatus of a type usable as a rock drill, and particularly to an apparatus having a body with a cylinder space, a moving piston, and a liner-type distributing valve surrounding the piston.

BACKGROUND OF THE INVENTION

Hydraulic striking devices of the general type shown in the present application have recently been constructed and sold by various manufacturers because of the economies of using liquid under pressure as compared with pneumatic devices using compressed air. A structure of similar type is shown in U.S. patent application serial No. 569,531, Salmi et al, filed Apr. 18, 1975, now U.S. Pat. No. 4,028,995 which apparatus includes a body having a cylinder space, a piston and cylinder structure axially movable therein, and a sleeve or liner-type distributing valve surrounding the movable piston and axially movable relative to the other component for controlling the action of the piston therein. As shown in that application, when the distributing valve is in its lowest position (nearest the tool end of the device) and the piston is in or near its lowest position, the liquid under pressure flows from a lower cylinder space through a canal in the piston to that portion of the distributing valve space which is defined by the body, the piston and the lower end of the distributing valve. Pressure is thereby applied to the distributing valve to move it to its upper position and that part of the distributing valve space is filled with liquid under pressure. When the piston moves to its upper position, the liquid under pressure escapes from that part of the distributing valve space through the piston canal into an outlet canal. It is possible to utilize this escaping oil for rotating the rotating motor of a drilling machine as shown in U.S. patent appliation Ser. No. 649,679, Salmi, filed Jan. 17, 1976 now U.S. Pat. No. 4,039,033. However, in devices wherein the oil is not utilized for some other purpose, it is simply wasted. Because the amount of the wasted liquid under pressure in the apparatus shown in application Ser. No. 569,531 is relatively large, this is a disadvantage of the construction described in that application.

BRIEF SUMMARY OF THE INVENTION

An object of the present invention is to provide an improved apparatus in which the amount of liquid under pressure which is required for moving the distributing valve upwardly and, correspondingly, also the amount wasted is smaller than in prior art structures, but wherein the reliability of the operational condition for the movement of the distributing valve is not reduced.

Briefly described, the invention includes an improved hydraulic striking apparatus of the type having a body having wall means defining a cylindrical space therein having a cylindrical inner surface of substantially uniform diameter and end walls, a piston axially movable in said space, and a sleeve type distributing valve in said space between said piston and said wall means, the improvement comprising: an annular member extending radially inwardly from said inner surface and dividing said space into first and second portions; said piston having a flange portion axially movable radially inwardly of said annular member; said distributing valve having a distributor portion disposed in said first portion of said space between said annular member and one of said end walls and in sliding contact with said inner surface, said distributor portion having a first annular end surface on which fluid under continuous full pressure acts; and an extension portion attached to and slidable with said distributor portion, the outer surface of said extension portion being in sliding contact with said annular member in all positions of said valve, said extension portion having a second annular end surface against which fluid under continuous full pressure acts, the area of said second surface being smaller than the area of said first end surface; the inner surface of said valve being in sliding contact with the outer surface of said flange portion of said piston; means in said piston defining a canal for permitting flow of fluid axially past said annular member; a shoulder on said distributor portion adjacent said extension portion, said shoulder, said annular member, said inner surface of said space and the outer surface of said extension portion defining a distributor space; and means in said extension portion defining radial openings for permitting fluid under pressure to pass therethrough; said canal means and said radial openings providing a fluid path from said second portion of said space to said distributor space, said flange portion of said piston being movable toward said first space portion to close said path.

Figure 2:
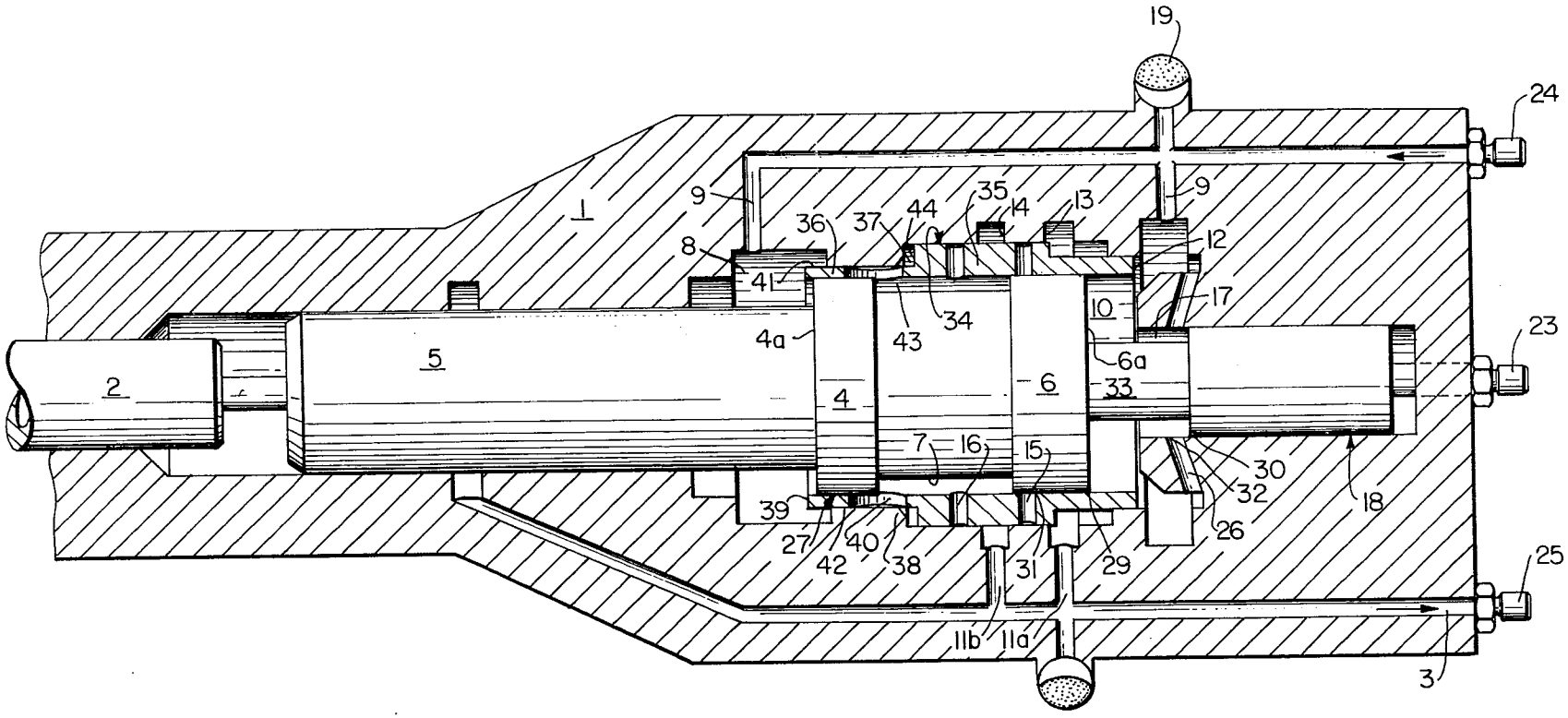

In order that the manner in which the foregoing and other objects are attained in accordance with the invention can be understood in detail, a particularly advantageous embodiment thereof will be described with reference to the accompanying drawings which form a part of this specification and wherein:

FIG. 1 is a side elevation, in partial section, of a striking apparatus in accordance with the invention showing the piston in its lowest position at the end of a work stroke; and FIG. 2 is a side elevation, in partial section, similar to FIG. 1 but showing the piston at the beginning of a work stroke.

In this application, the terms "down", "under" and "lower" will be used to refer to directions toward that end of the apparatus to which the tool is attached, i.e., the left end of the drawings as shown in FIGS. 1 and 2. Consistent with this, the terms "up", "above" and "upper" will be used to refer to the opposite end of the apparatus, i.e., to the right in FIGS. 1 and 2. Also, in this text, the word "canal" is used in its singular form, although reference in some cases may be made to a network of canals including several individual passages.

As shown in the drawings, the apparatus includes a body 1 having a cylinder space therein which contains a piston indicated generally at 27. The piston includes a rod 5, a lower flange 4, an upper flange 6, an intermediate portion 7 having a diameter smaller than flanges 4 and 6, thus forming an annular canal 43, and an upper extension 18. All of these portions of the piston are connected to each other and are axially movable with each other within the cylinder space of body 1 so that in moving to and fro the distal end of rod 5 strikes the upper end of tool 2 and then is retracted therefrom.

The cylinder space includes a lower space 8 which is generally below flange 4 and an upper space 10 which is generally above flange 6. If tool 2 is not in its place, piston 27 is stopped in an absorber space 21 which is closed by flange 4 when the piston is in its lowermost position and wherein the pressure in the absorber space rises high enough to stop the motion of the piston, the inner diameter of space 21 being approximately equal to the outer diameter of flange 4. An additional cylinder space 17 which receives extension 18 connects upper space 10 with an inlet canal 9 through a canal 26 when piston 27 comes close to its uppermost position at which the direction of its motion reverses. A flushing tube 23 extends through the striking apparatus for the purpose of conveying a flushing liquid into a hole which extends through tool 2. Liquid under pressure is conveyed through a pressure pipe into the apparatus, the pipe being connected to a nipple 24 which supplies liquid under pressure into canal 9. Similarly, the return liquid is conveyed away from the apparatus to a return pipe at nipple 25. From nipple 24 in body 1 of the apparatus canal 9 conveys liquid under pressure to lower space 8, upper space 10 and pressure accumulator 19. Accumulator 19 balances the liquid flows and the changes in pressure.

Inlet canal 9 is continuously connected with lower space 8 and, through distributing valve 34 and the cylinder space 17 of extension 18 and through canal 26, with upper space 10. Differences in diameter of piston 27 are such that the lower surface 4*a* of flange 4 which is continuously under pressure is smaller than the upper surface 6*a* of flange 6. Thus, when liquid under pressure flows into upper space 10, the pressures are unbalanced such that piston 27 tends to move downwardly. It follows that when upper space 10 is vented to the return path, the liquid pressure in space 8 causes the piston to move upwardly.

The liner-type distributing valve 34 moves in its space which is in body 1, the valve being immediately around that part of cylinder space 8 and 10 in which the flanges 4 of piston 27 move. Distributing valve 34 comprises a distributing part 35 and a liner-type extension 36 of the lower end of distributing part 35. The inner diameter of the liner-type extension 36 corresponds to the inner diameter of distributing part 35, but the outer diameter of extension 36 is smaller than the outer diameter of the lower end of distributing part 35. Thus, the surface of the lower end of distributing part 35 which subjected to intermittent pressure consists of an annular lower surface 44 which is formed as a shoulder at the lower end of distributing part 35 and adjacent the upper end of extension 36, the inner diameter of surface 44 being equal to the outer diameter of extension 36 and the outer diameter being equal to the outer diameter of the lower end of distributing part 35. A space 37 is formed in body 1 by an annular radially inwardly extending neck 38 which separates lower space 8 from the distributing valve space, space 37 being defined by the upper surface of neck 38, surface 44, the outer surface of extension 36 and the inner surface of the upper portion of the cylindrical space. The cylindrical outer surface 41 of extension 36 of the distributing valve slides along the cylindrical inner surface 42 of neck 38. The liner-type extension 36 is sufficiently long so that, regardless of the postion of distributing valve 34, some portion of the extension is always in contact with the cylindrical inner surface 42 of neck 38.

Extension 36 of valve 34 is provided with radial openings 40 to permit fluid to pass between lower space 8 and distributor space 37 when the piston and valve are in the proper position, the fluid being permitted to pass around flange 4, through the canal space in the piston defined by reduced diameter portion 7, and through openings 40. Portion 35 of the valve is provided with radial openings 15 and 16 which, with the distributor valve in the postion shown in FIG. 1, can permit radial flow of fluid to annular recesses 13 and 14 which are formed in body 1 and which are communication with canals 11*a* and 11*b*, respectively, to conduct escaping fluid to canal 3 and accumulator 19.

As mentioned, in order to let the liquid under pressure flow into that part of the space 37 of the distributing part of the distributing valve which is defined by body 1, the lower surface 44 of the distributing part and the liner-type extension 36 of the distributing valve when piston 27 is in its lowest position or near to it, there are openings 40 in extension 36. For the same purpose, there is the canal 43 in the piston which is defined by the reduced portion 7 between flanges 4 and 6, the canal in this case being annular in order to let the liquid under pressure flow from the lower space 8 along canal 43 through openings 40 into space 37 when the piston 27 is in its lower position and in spite of the fact that the piston 27 can freely rotate around its longitudinal axis. Regardless of that rotation, the path to openings 40 exists. When lower surface 44 of the distributing part is subjected in this manner to full pressure which, at the same time, naturally also affects the lower surface 39 of extension 36, the distributing valve 34 moves upwardly because the total area of surface 39 and 44 is larger than the area 12 of the upper surface of the distributing part. When the distributing valve 34 is sufficiently high, as in FIG. 1, the liquid can flow from the upper space 10 through openings 15 in the distributing valve 34 and through outlet 11*a* into escape canal 3.

The mutual operation of distributing valve 34 and piston 27 is, in principle, equivalent to the operation described in U.S. patent application Ser. No. 569,531, mentioned above. However, there are certain differences in operation because of the changes in the piston structure and the provision of extension 36.

FIG. 1 presents a situation wherein the piston has just struck tool 2 and is now starting its return movement. The distributing valve 34 is in its uppermost position stopped by absorber space 20. The pressure from the inlet canal 9 into upper space 10 is completely closed by the upper portion of the distributing valve and extension 18 of the piston. The escape path through opening 15 and outlet canal 11*a* into escape canal 3 is open. Thus, the pressure in the lower space 8 forces the piston 27 to move up. The space 37 of the distributing part 35 of the distributing valve is in connection with the lower space 8 through canals 43 in piston flange 4 and openings 40.

The return movement of the piston is, at first, accelerated while the liquid of the upper space 10 escapes through opening 15 and outlet canal 11*a* into escape canal 3. The acceleration decreases and, finally, the movement of the piston starts to slow down as the upper end 29 of piston flange 6 starts to choke the flow into opening 15, whereupon the pressure in upper space 10 begins to rise. Flange 33 of extension 18 of the piston opens the connection from upper space 10 into the inlet canal 9 through canal 26 at the time when the lower edge 30 of flange 33 of the extension reaches the lower end 32 of canal 26. In order to prevent the pressure of the upper space 10 from rising far over the average pressure in the pressure side of the striking apparatus, the opening of canal 26 occurs slightly before piston flange 6 completely closes the connection between space 10 and opening 15, this occurring when upper end 29 of piston flange 6 reaches the upper edge 31 of opening 15. When opening 15 is closed, the outlet phase into the outlet canal 11 has come to an end and piston 27 continues its movement with decreasing speed. The liquid displaced by the piston while it is moving through the final stage of this movement flows through canal 26 into inlet canal 9 and is stored in accumulator 19.

Distributing valve 34 starts to move from the upper position into its lower position when the piston has moved upwardly so far that the liquid under pressure from space 37 below the lower surface 44 has a flow passage through openings 40 and canal 43 and also through openings 16 in the distributing valve to outlet canal 11*b*. The downward movement of the distributing valve is then possible because the area of the lower surface 39 of extension 36, which is continuously subjected to full pressure, is smaller than the area of the upper end 12 of part 35 which is likewise continuously subjected to full pressure. When the distributing valve 34 has moved to its lower position, it closes the connection from openings 15 to outlet canal 11*a* and also the connection from the openings 16 to outlet canal 11*b*.

As shown in FIG. 2, the piston 27 is ready to start its downward stroke. The upper space 10 is filled with liquid under pressure from inlet canal 9 through canal 26 and cylinder space 17 of the extension of the piston, and through the circular opening opened by distributing valve 34 adjacent upper edge 12 thereof. When the piston has moved down enough, the lower end 30 of flange 33 of the extension closes the connection from the inlet canal 9 through canal 26 into upper space 10. The piston has been stopped by the absorber 21 in its lower position. When piston 27 is moving downwardly, it opens, a little before the stroke, the connection from lower space 8 into space 37 of the distributing part of the distributing valve, below the lower surface 44, through canals 43 and openings 40. Behind the lower surface 44 of the distributing part 35, the pressure rises, thereby causing the distributing valve to move upwardly. While the stroke takes place, the distributing valve 34 closes the connection from inlet canal 9 to the upper space 10 and opening 15 opens to outlet canal 11*a*. The distributing valve 34 is stopped by absorber 20 in the position shown in FIG. 1. As will be seen, the apparatus in accordance with the invention accomplishes the previously stated objective in that the part of the space 37 of the distributing part of the distributing valve, which is defined by body 1, the lower surface 44 of the distributing part and the liner-type extension 36, is smaller than that part of the distributing valve according to U.S. patent application Ser. No. 569,531, now U.S. Pat. No. 4,028,995 wherein the space is defined by the body, the lower end of the distributing valve without the extension, and piston flange. Thus, when the distributing valve moves from the upper position to the lower position, the amount of the escaping fluid is substantially smaller in the construction according to the present invention than in the previous apparatus. Compared with the apparatus shown in the previously mentioned application, the apparatus of the present invention provides a saving of as much as 10% of the pressure liquid in this improved arrangement.

While one advantageous embodiment has been chosen to illustrate the invention, it will be understood by those skilled in the art that various changes and modifications can be made therein without departing from the scope of the invention as defined in the appended claims.

What is claimed is:

1. In an improved hydraulic striking apparatus of the type having a body having wall means defining a cylindrical space therein having a cylindrical inner surface and end walls, a piston axially movable in said space, and a sleeve type distributing valve in said space between said piston and said inner surface, the improvement comprising:

an annular member extending radially inwardly from said inner surface and dividing said space into first and second portions;

said piston having a flange portion axially movable radially inwardly of said annular member;

said distributing valve having a distributor portion disposed in said first portion of said space between said annular member and one of said end walls and in sliding contact with said inner surface, said distributor portion having a first annular end surface on which fluid under continuous full pressure acts; and an extension portion attached to and slidable with said distributor portion, the outer surface of said extension portion being in sliding contact with said annular member in all positions of said valve, said extension portion having a second annular end surface against which fluid under continuous full pressure acts, the area of said second surface being smaller than the area of said first end surface;

the inner surface of said valve being in sliding contact with the outer surface of said flange portion of said piston;

means in said piston defining a canal for permitting flow of fluid axially past said annular member;

a shoulder on said distributor portion adjacent said extension portion, said shoulder, said annular member, said inner surface of said space and the outer surface of said extension portion defining a distributor space; and means in said extension portion defining radial openings for permitting fluid under pressure to pass therethrough;

said canal means and said radial openings providing a fluid path from said second portion of said space to said distributor space, said flange portion of said piston being movable toward said said first space portion to close said path.

2. An apparatus according to claim 1 wherein said body further includes an outlet canal for fluid to emerge from said body, and wherein said canal means and said radial openings provide a fluid path between said distributor space and said outlet canal when said piston approaches its limit of axial movement in the direction of said first space.

3. In an improved hydraulic striking apparatus of the type having a body having wall means defining a cylindrical space therein having a cylindrical inner surface and end walls, an annular projection extending radially inwardly from said inner surface and dividing said space into first and second portions, a piston axially and reciprocatingly movable in said space to contact a tool, said piston having a flange, means for supplying hydraulic fluid under pressure to said space for moving said piston, a sleeve type distributing valve in the first portion of said space between said piston and said wall means, and an outlet canal, the improvement comprising an axially extending annular valve member means carried by said distributing valve and movable between and in continuous sliding contact with said piston and said annular projection, said axially extending member having radial holes therein, said annular projection, said sleeve valve, said cylindrical inner surface and said axially extending valve member defining a distributing valve space, and a canal in said piston, whereby, when said piston approaches a position closest to the tool, the second portion of said space is connected with said distributing valve space through a path including said piston canal and said radial holes, and when said piston approaches its position farthest from the tool, said piston flange closes said path.

* * * * *